US007448911B2

(12) United States Patent
Yang

(10) Patent No.: US 7,448,911 B2
(45) Date of Patent: Nov. 11, 2008

(54) DETACHABLE LAMP SOCKET

(75) Inventor: Wen-Ho Yang, Taipei County (TW)

(73) Assignee: Sun-Lite Socketrs Industry Inc., Taoyuan (TW)

( * ) Notice: Subject to any disclaimer, the term of this patent is extended or adjusted under 35 U.S.C. 154(b) by 242 days.

(21) Appl. No.: 11/439,106

(22) Filed: May 23, 2006

(65) Prior Publication Data

US 2007/0275576 A1 Nov. 29, 2007

(51) Int. Cl.
*H01R 33/09* (2006.01)

(52) U.S. Cl. ..... 439/619; 439/333; 439/337; 439/699.2; 439/620.02

(58) Field of Classification Search ..... 439/617, 439/619, 300, 699.2, 76.1, 337, 620.02
See application file for complete search history.

(56) References Cited

U.S. PATENT DOCUMENTS 4,688,874 A * 8/1987 Bjorkman ..... 439/56
4,723,200 A * 2/1988 Troen ..... 362/260
5,577,835 A * 11/1996 Huang ..... 362/353
7,033,220 B1 * 4/2006 Yang ..... 439/617
7,097,508 B1 * 8/2006 Yang ..... 439/617
7,104,828 B1 * 9/2006 Lin ..... 439/337
7,125,159 B2 * 10/2006 Hirsch et al. ..... 362/651

* cited by examiner

*Primary Examiner*—Truc T Nguyen
*Assistant Examiner*—Xuong M Chung-Trans
(74) *Attorney, Agent, or Firm*—Alan Kamrath; Kamrath & Assocaites PA

(57) ABSTRACT

A detachable lamp socket includes a top cover, a mounting plate secured on the top cover, a housing detachably mounted on the mounting plate, a base secured in the housing, a circuit board mounted in the housing and supported by the base, and a locking rod movably mounted in the base and having a first end extended through the circuit board and the housing and retractably extended into the mounting plate to lock the housing onto the mounting plate. Thus, the housing can be rotated relative to the mounting plate to detach the housing from the mounting plate for maintenance of the lamp socket.

19 Claims, 15 Drawing Sheets

DETACHABLE LAMP SOCKET

BACKGROUND OF THE INVENTION

1. Field of the Invention

The present invention relates to a lamp socket and, more particularly, to a PL type lamp socket.

2. Description of the Related Art

A conventional PL type lamp socket comprises a seat portion having a first portion mounted in the panel of a ceiling and a second end formed with a socket to allow insertion of a lamp tube. However, the lamp socket has a fixed structure so that the lamp socket cannot be detached for maintenance of the inner parts contained in the lamp socket. In addition, the lamp socket is located at a higher location, so that a user has to rise to the higher location to mount the lamp tube onto the lamp socket, thereby causing inconvenience to the user.

BRIEF SUMMARY OF THE INVENTION

The primary objective of the present invention is to provide a detachable lamp socket, wherein the housing is detachable from the top cover.

Another objective of the present invention is to provide a lamp socket, wherein after the lamp tube is inserted into the slot of the base, the second end of the locking rod is pushed upward by the lamp tube, and the first end of the locking rod is pushed upward and extended into one of the through holes of the mounting plate to secure the housing to the mounting plate, so that the housing cannot be rotated relative to the mounting plate to prevent the housing from being rotated relative to the mounting plate when the lamp socket is turned on, thereby protecting the user's safety when operating the lamp socket.

A further objective of the present invention is to provide a lamp socket, wherein the first end of the locking rod is extended into one of the through holes of the mounting plate only when the through hole of the housing is aligned with one of the through holes of the mounting plate, so that the housing is connected with the mounting plate exactly only when the first end of the locking rod is extended into one of the through holes of the mounting plate, thereby ensuring exact connection between the housing and the mounting plate.

A further objective of the present invention is to provide a lamp socket, wherein after the lamp tube is removed from the slot of the base, the locking rod is pushed downward by the restoring force of the restoring member, and the first end of the locking rod is pushed downward to detach from one of the through holes of the mounting plate to release the housing from the mounting plate, so that the housing can be rotated relative to the mounting plate to detach the housing from the mounting plate for maintenance of the lamp socket.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
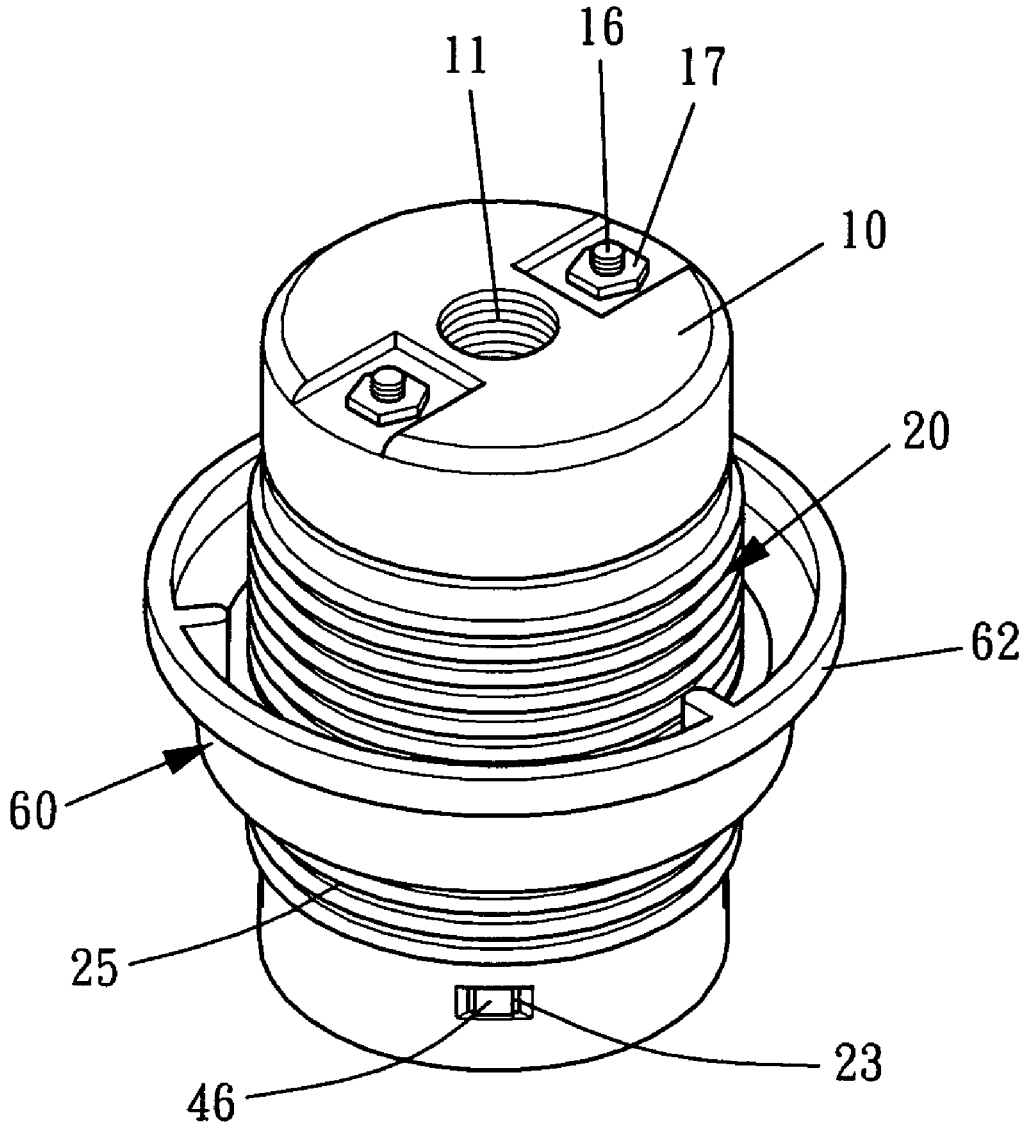
FIG. 1 is a perspective view of a lamp socket in accordance with the preferred embodiment of the present invention.
Figure 2:
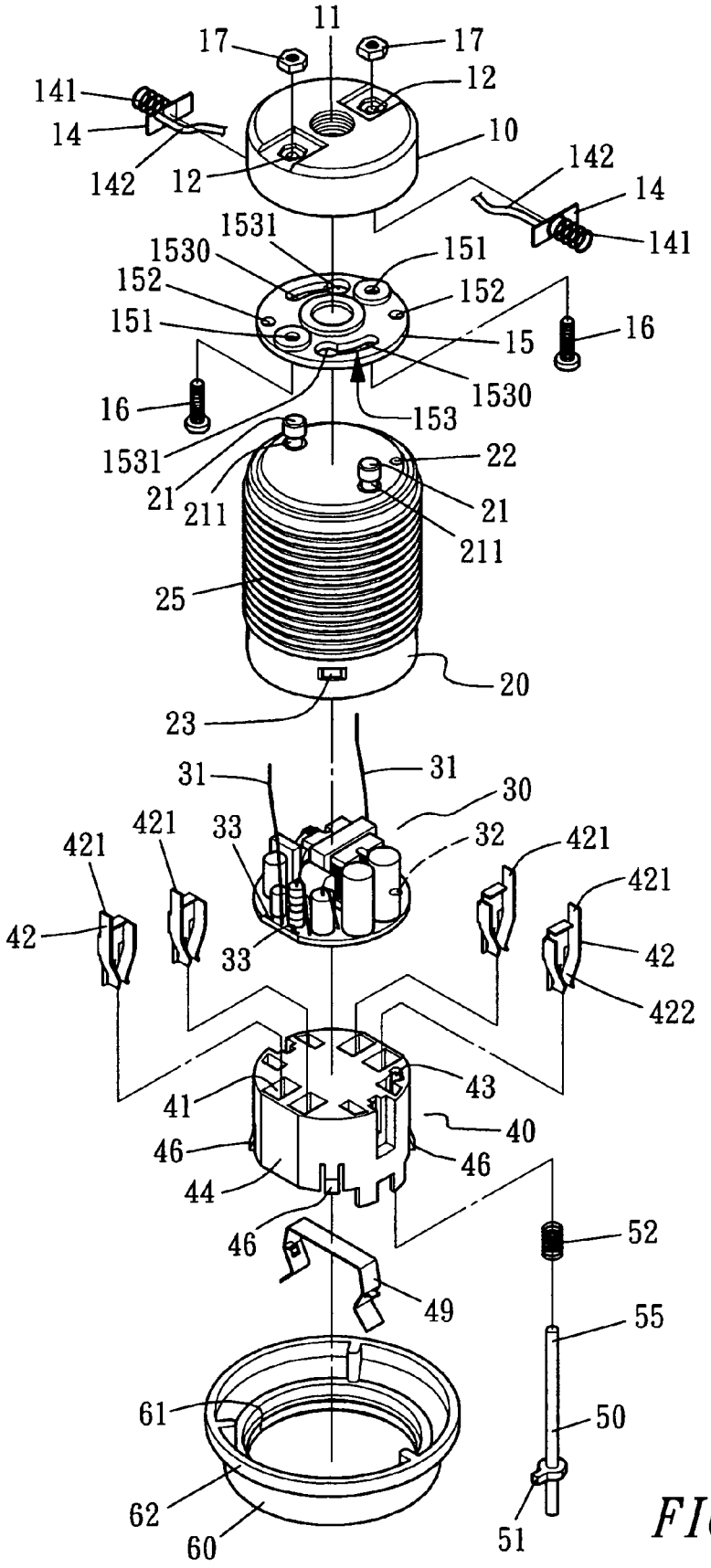
FIG. 2 is an exploded perspective view of the lamp socket as shown in FIG. 1.
Figure 3:
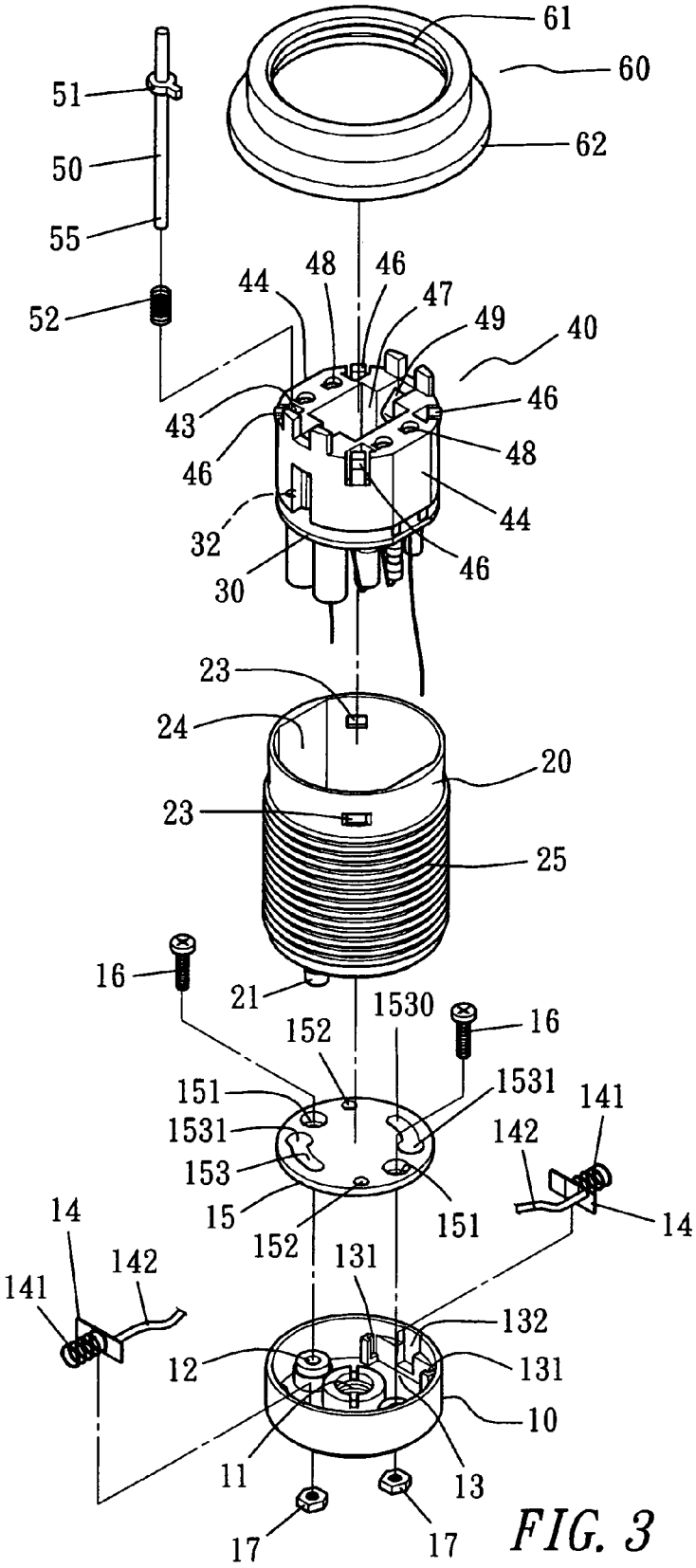
FIG. 3 is an exploded perspective view of the lamp socket as shown in FIG. 1.

Referring to the drawings and initially to FIGS. 1-10, a lamp socket in accordance with the preferred embodiment of the present invention comprises a top cover 10, a mounting plate 15 secured on the top cover 10, a housing 20 detachably mounted on the mounting plate 15, a base 40 secured in the housing 20, a circuit board 30 mounted in the housing 20 and supported by the base 40, and a locking rod 50 movably mounted in the base 40 and having a first end 55 extended through the circuit board 30 and the housing 20 and retractably extended into the mounting plate 15 to lock the housing 20 onto the mounting plate 15.

The top cover 10 has a cylindrical shape. The top cover 10 has a central portion formed with a screw bore 11. The top cover 10 has two radially opposite fixing holes 12. The top cover 10 has a hollow inside formed with two opposite slots 13 and two receiving recesses 132 each aligning with the respective slot 13. Each of the slots 13 of the top cover 10 is defined by two substantially L-shaped limit plates 131.

The lamp socket further comprises two electrically conducting plates 14 each inserted into the respective slot 13 of the top cover 10 and each limited by the limit plates 131 of the respective slot 13, two elastic members 141 each mounted in the respective receiving recess 132 of the top cover 10 and each biased between the top cover 10 and the respective electrically conducting plate 14 to push the respective electrically conducting plate 14 toward the central portion of the top cover 10, and two electric wires 142 each having a first end attached to the respective electrically conducting plate 14 and a second end extended through the screw bore 11 of the top cover 10 and electrically connected to a power supply (not shown). Each of the electrically conducting plates 14 has a thickness smaller than that of the respective slot 13 of the top cover 10 so that each of the electrically conducting plates 14 is movable in the respective slot 13 of the top cover 10.

The mounting plate 15 has a circular shape and has two radially opposite guide slots 153 each having a first end 1530 aligning with the respective electrically conducting plate 14 and a second end formed with a circular hole 1531. The circular hole 1531 of each of the guide slots 153 has a size greater than that of each of the guide slots 153. The mounting plate 15 also has two radially opposite fixing holes 151 each connected to the respective fixing hole 12 of the top cover 10 by a locking screw 16 and a locking nut 17 to attach the mounting plate 15 to the top cover 10. The mounting plate 15 also has two radially opposite through holes 152, and the first end 55 of the locking rod 50 is retractably extended into one of the through holes 152 of the mounting plate 15.

The housing 20 has a cylindrical shape and has a top face provided with two radially opposite metallic conducting rods 21 each detachably locked in the respective guide slot 153 of the mounting plate 15 and each urged on the respective electrically conducting plate 14. Each of the conducting rods 21 of the housing 20 is inserted through the circular hole 1531 into the respective guide slot 153 of the mounting plate 15 to reach the first end 1530 of the respective guide slot 153 and has a reduced neck portion 211 slidably mounted in the respective guide slot 153 of the mounting plate 15. The top face of the housing 20 is formed with a through hole 22 to allow passage of the locking rod 50. The housing 20 has a hollow inside to receive the circuit board 30 and the base 40. The housing 20 has an inner wall formed with two radially opposite guide faces 24 and an outer wall formed with an outer thread 25. The housing 20 has a lower portion having a peripheral wall formed with a plurality of locking holes 23.

The circuit board 30 is provided with a plurality of electronic parts to transform, filter and rectify an electric current introduced into the circuit board 30 so as to start a lamp tube (not shown). The circuit board 30 is provided with two electric wires 31 each electrically connected to the respective conducting rod 21 so that the electric current from the conducting rods 21 is introduced into the circuit board 30. The circuit board 30 is formed with a through hole 32 to allow passage of the locking rod 50. The circuit board 30 has a periphery formed with a plurality of locking holes 33.

The base 40 has a cylindrical shape and has a top face formed with a plurality of receiving chambers 41 and a bottom face having a central portion formed with a slot 47 and a periphery formed with a plurality of insertion holes 48 each connected to the respective receiving chamber 41. The base 40 is formed with a through hole 43 to allow passage of the locking rod 50. The base 40 has a peripheral wall formed with a plurality of flexible locking hooks 46 each locked in the respective locking hole 23 of the housing 20. The base 40 has an outer wall formed with two radially opposite guide faces 44 each rested on the respective guide face 24 of the housing 20.

The lamp socket further comprises a tube clip 49 mounted in the slot 47 of the base 40, and a plurality of conducting clips 42 each mounted in the respective receiving chamber 41 of the base 40 and each having an upper end provided with a conducting plate 421 locked in and connected to the respective locking hole 33 of the circuit board 30 and a lower end 422 facing the respective insertion hole 48 of the base 40.

Thus, when the bottom portion (not shown) of the lamp tube is inserted into the slot 47 of the base 40, the bottom portion of the lamp tube has two locking blocks (not shown) which are clamped by the tube clip 49 and a plurality of electrically conducting posts (not shown) each inserted into the respective insertion hole 48 of the base 40 and each clamped by the lower end 422 of the respective conducting clip 42. In such a manner, the electric current from the circuit board 30 is introduced through the conducting clips 42 and the conducting posts into the lamp tube so as to light the lamp tube.

The locking rod 50 has a second end provided with a transverse bar 51 that is rotatable to rest on a stepped face 26 formed in the housing 20, and the lamp socket further comprises a restoring member 52 mounted on the locking rod 50 and biased between a stepped face 45 formed in the through hole 43 of the base 40 and the transverse bar 51 of the locking rod 50 to push the transverse bar 51 of the locking rod 50 toward the stepped face 26 of the housing 20. Thus, when the transverse bar 51 of the locking rod 50 is rested on the stepped face 26 of the housing 20, the first end 55 of the locking rod 50 is flush with the through hole 22 of the housing 20, and the second end of the locking rod 50 is exposed from the through hole 43 of the base 40 as shown in FIG. 4.

The lamp socket further comprises an outer ring 60 rotatably and movably mounted on the housing 20 and having an inner wall formed with an inner thread 61 screwed onto the outer thread 25 of the housing 20 and an inner wall formed with an annular urging portion 62.

Figure 4:
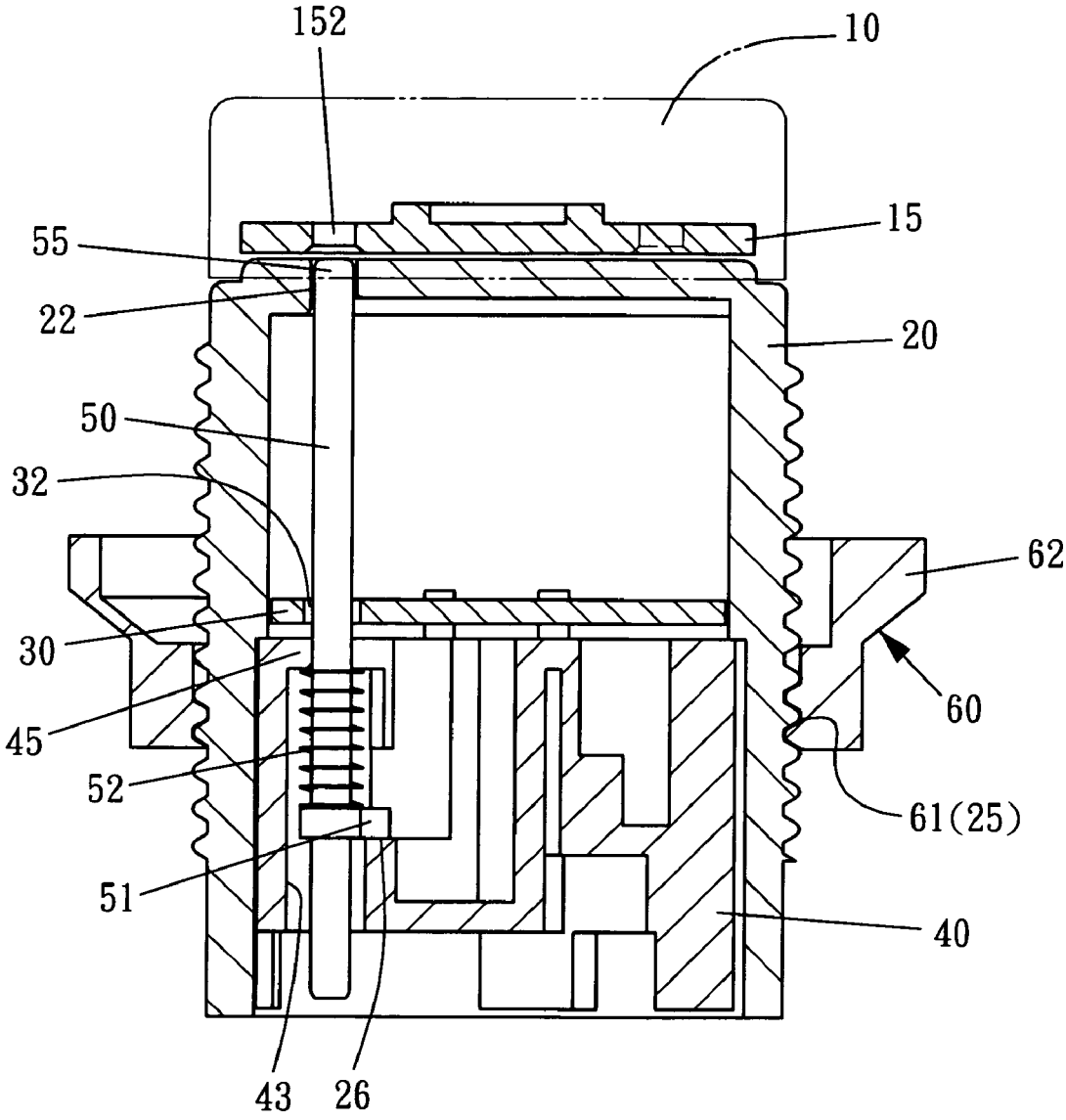
FIG. 4 is a plan cross-sectional view of the lamp socket as shown in FIG. 1.
Figure 5:
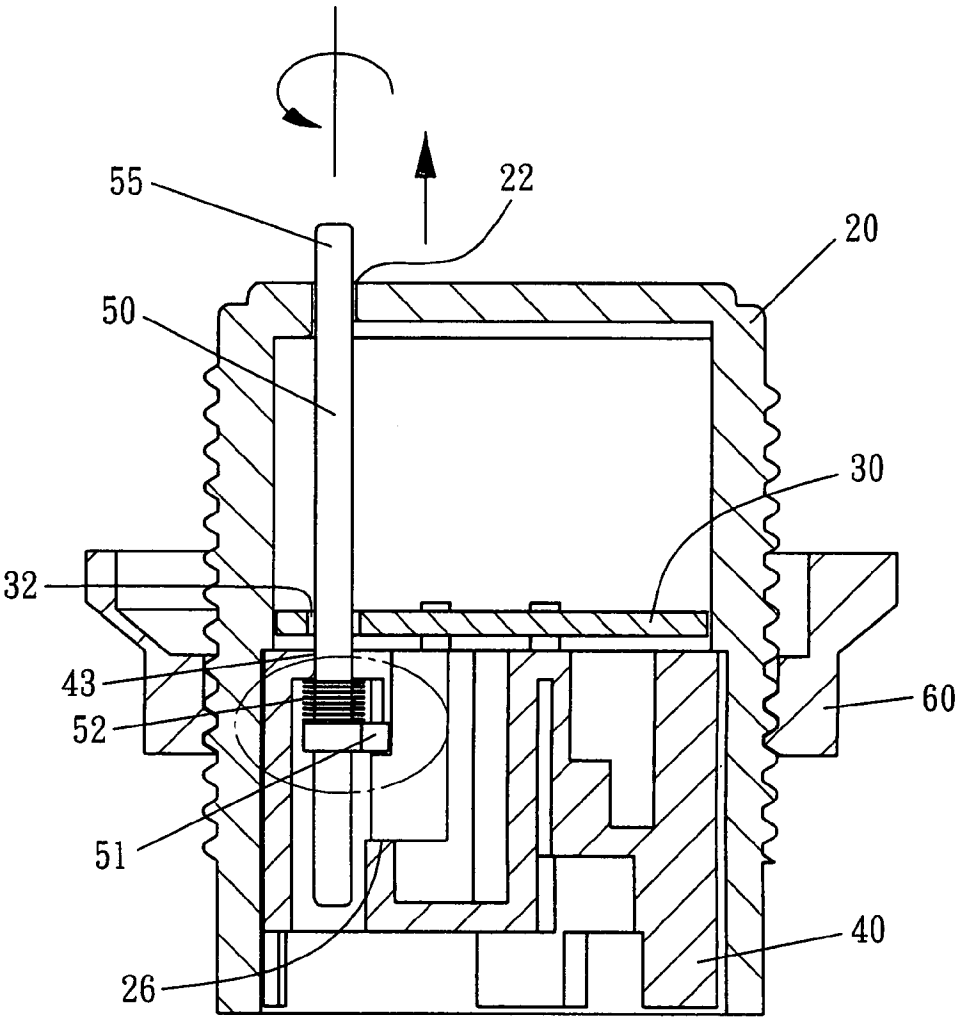
FIG. 5 is a schematic operational view of the lamp socket as shown in FIG. 4.
Figure 6:
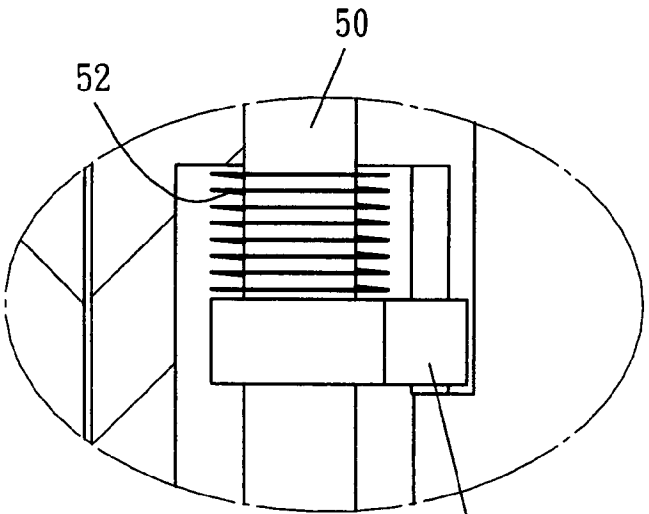
FIG. 6 is a locally enlarged view of the lamp socket as shown in FIG. 5.
Figure 7:
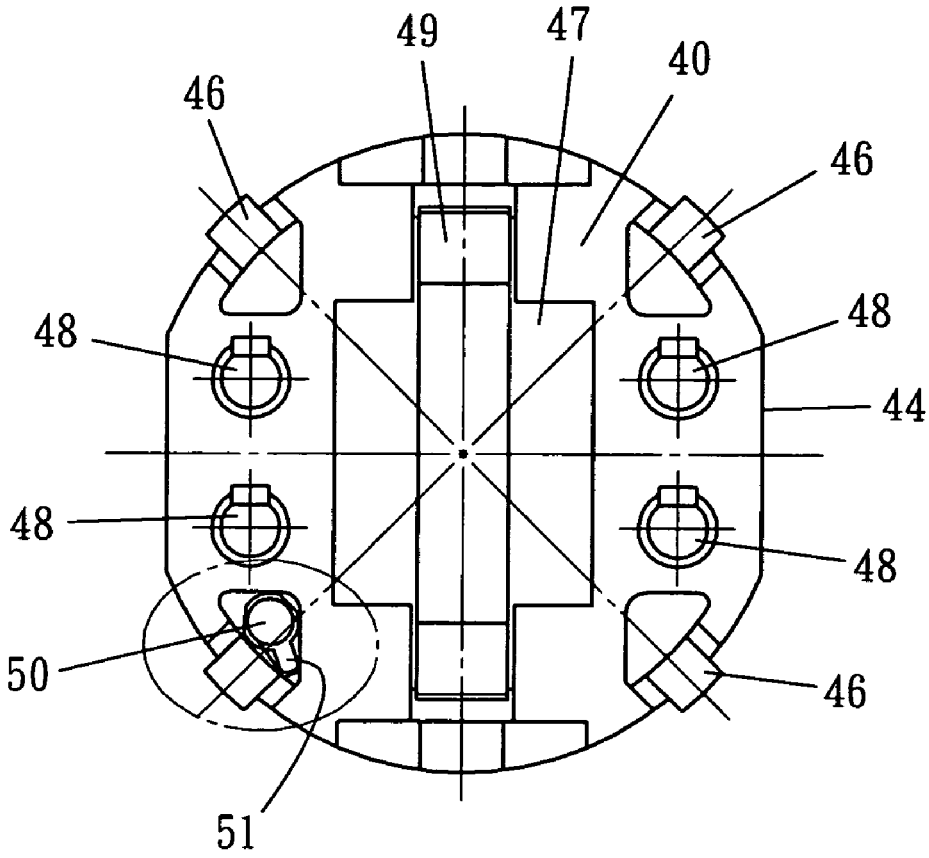
FIG. 7 is a bottom plan view of the lamp socket as shown in FIG. 1.
Figure 8:
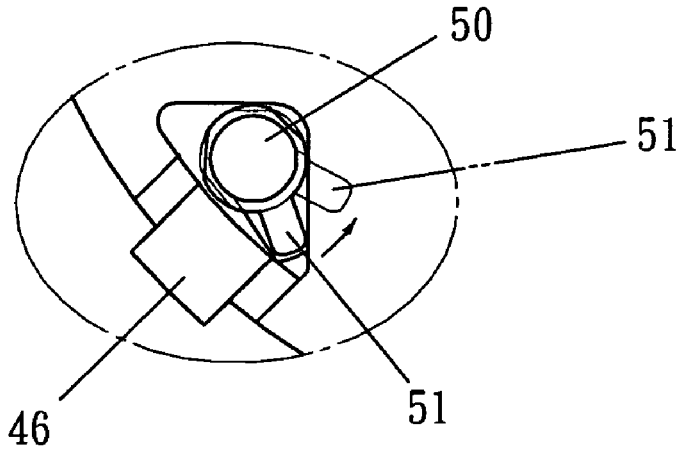
FIG. 8 is a locally enlarged operational view of the lamp socket as shown in FIG. 7.

In assembly, as shown in FIGS. 4-8, when the first end 55 of the locking rod 50 is pushed to protrude from the through hole 22 of the housing 20, the transverse bar 51 of the locking rod 50 is higher than the stepped face 26 of the housing 20 as shown in FIG. 5. Then, the locking rod 50 is rotated through a determined angle, so that the transverse bar 51 of the locking rod 50 is located above the stepped face 26 of the housing 20.

After the push force applied on the locking rod 50 is removed, the transverse bar 51 of the locking rod 50 is pushed toward the stepped face 26 of the housing 20 by the restoring force of the restoring member 52 so that the transverse bar 51 of the locking rod 50 is rested on the stepped face 26 of the housing 20 as shown in FIG. 4. Thus, the locking rod 50 is positioned in and will not detach from the housing 20. At this time, when the transverse bar 51 of the locking rod 50 is rested on the stepped face 26 of the housing 20, the first end 55 of the locking rod 50 is flush with the through hole 22 of the housing 20, and the second end of the locking rod 50 is exposed from the through hole 43 of the base 40.

Figure 9:
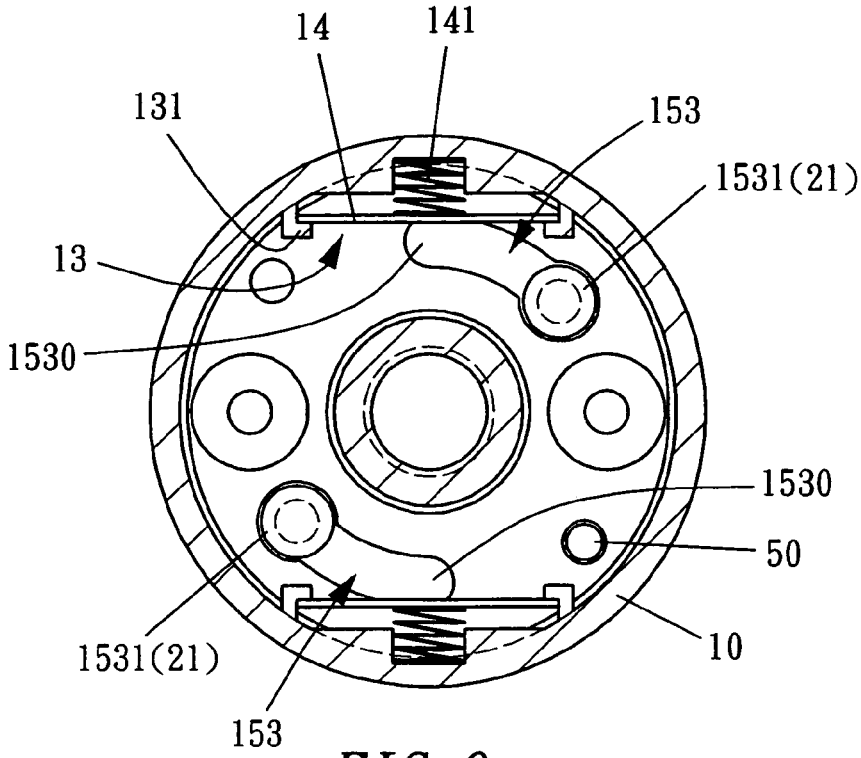
FIG. 9 is a plan cross-sectional view of the lamp socket as shown in FIG. 1.

As shown in FIG. 9, each of the conducting rods 21 of the housing 20 is inserted through the circular hole 1531 into the respective guide slot 153 of the mounting plate 15.

Figure 10:
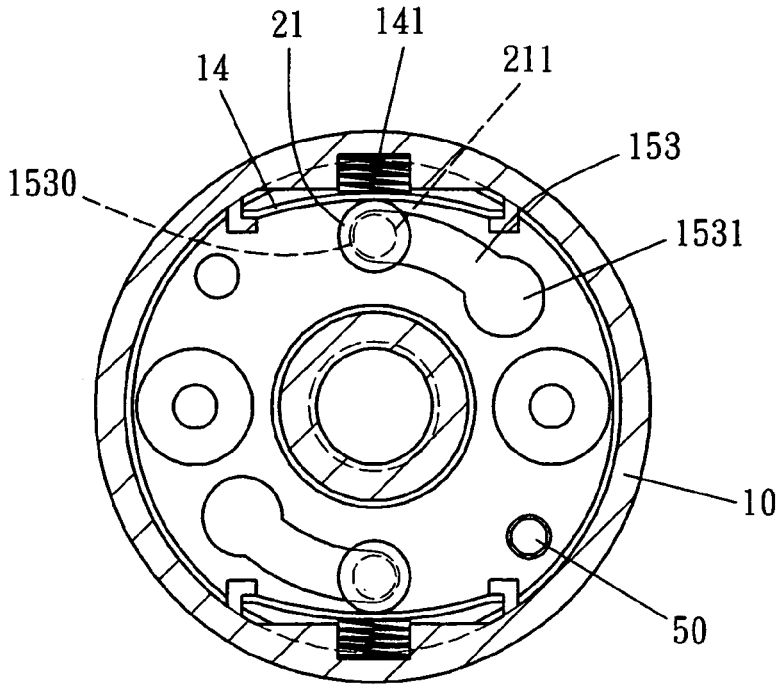
FIG. 10 is a schematic operational view of the lamp socket as shown in FIG. 9.

As shown in FIG. 10, when the housing 20 is rotated relative to the mounting plate 15, the neck portion 211 of each of the conducting rods 21 is slidable in the respective guide slot 153 of the mounting plate 15 to reach the first end 1530 of the respective guide slot 153, so that each of the conducting rods 21 is urged on the respective electrically conducting plate 14 to compress the respective elastic member 141. Thus, each of the conducting rods 21 is electrically connected to the respective electrically conducting plate 14 exactly and smoothly.

Figure 11:
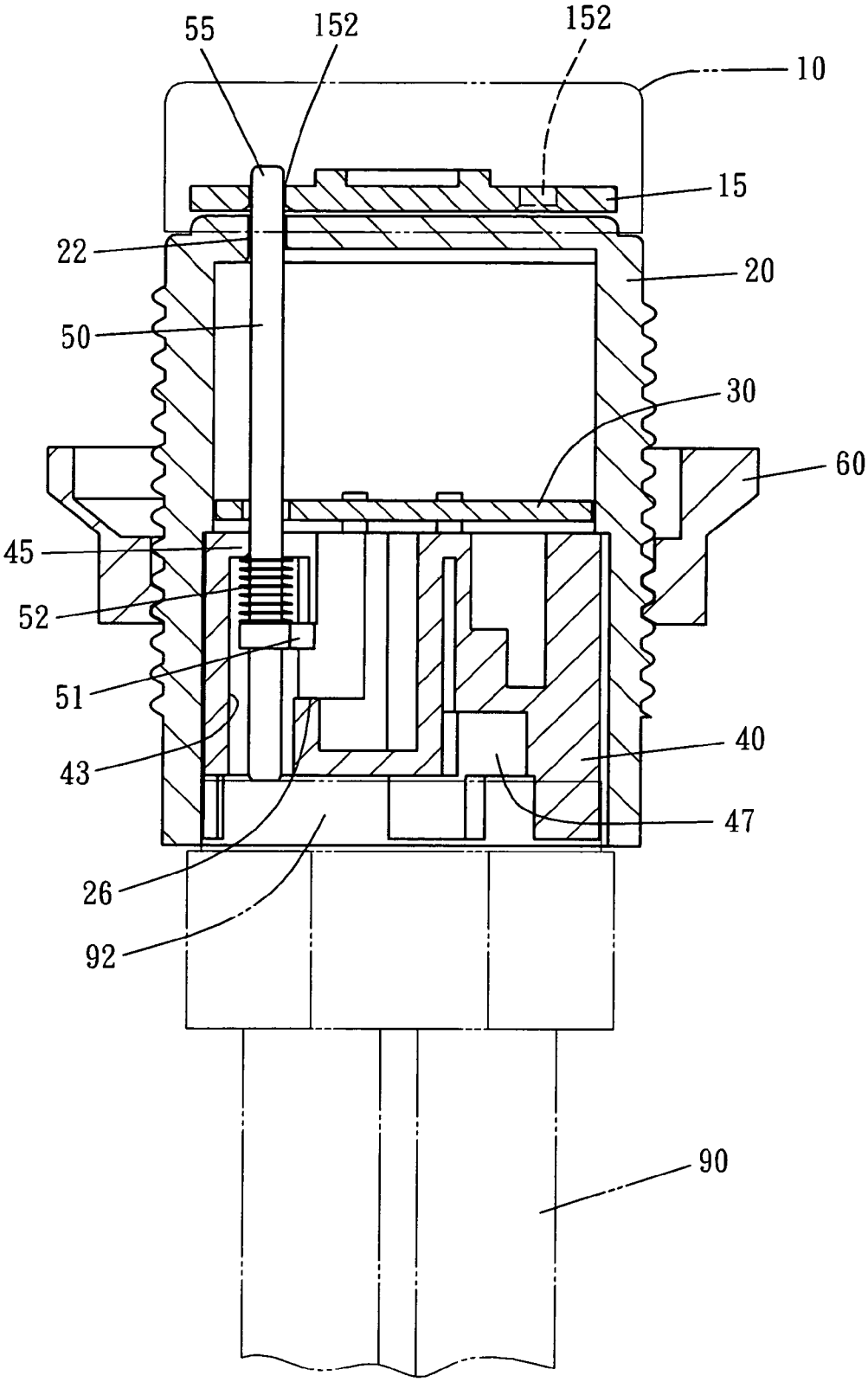
FIG. 11 is a schematic operational view of the lamp socket as shown in FIG. 4.
Figure 12:
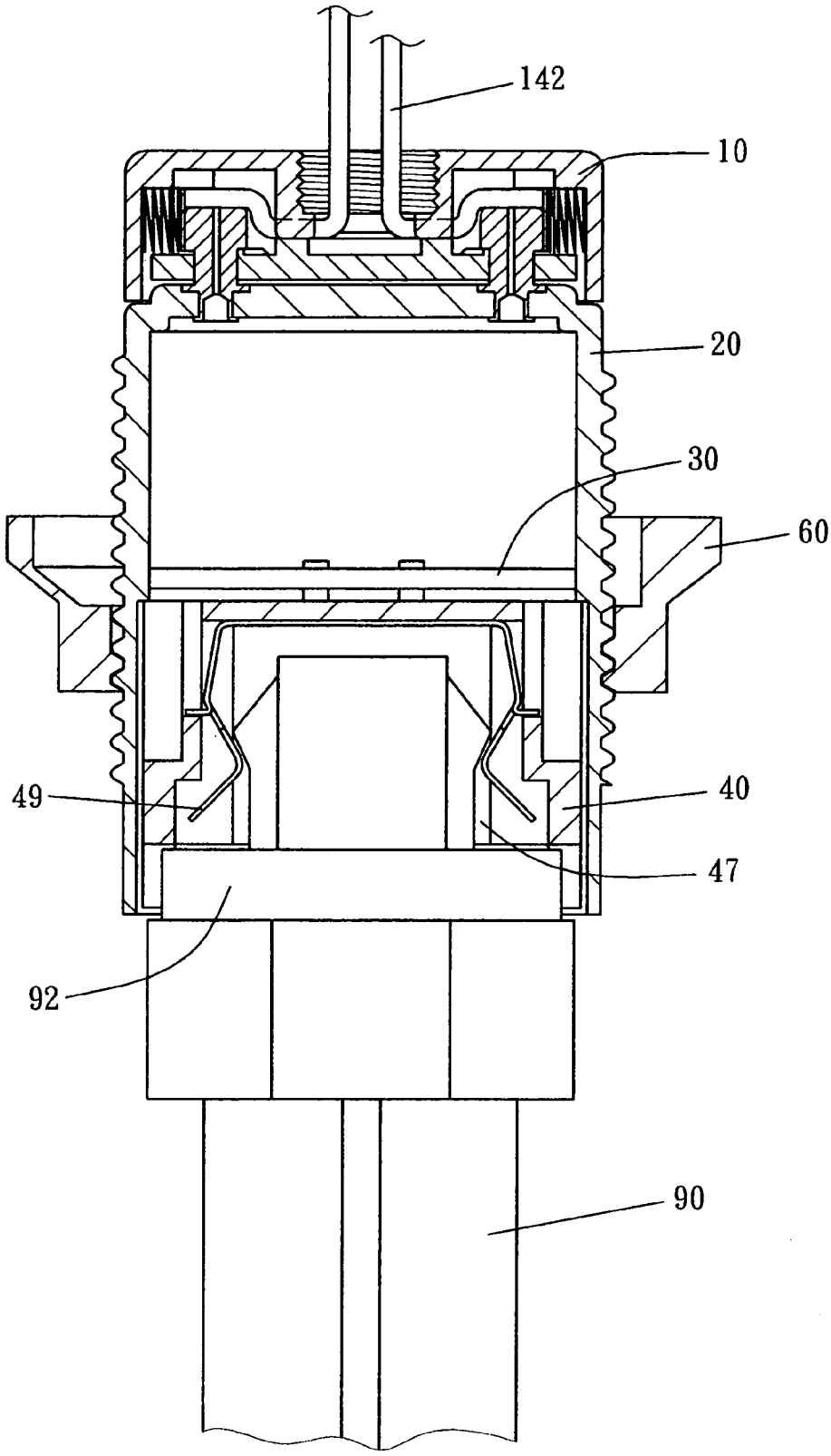
FIG. 12 is a schematic operational view of the lamp socket as shown in FIG. 11.
Figure 13:
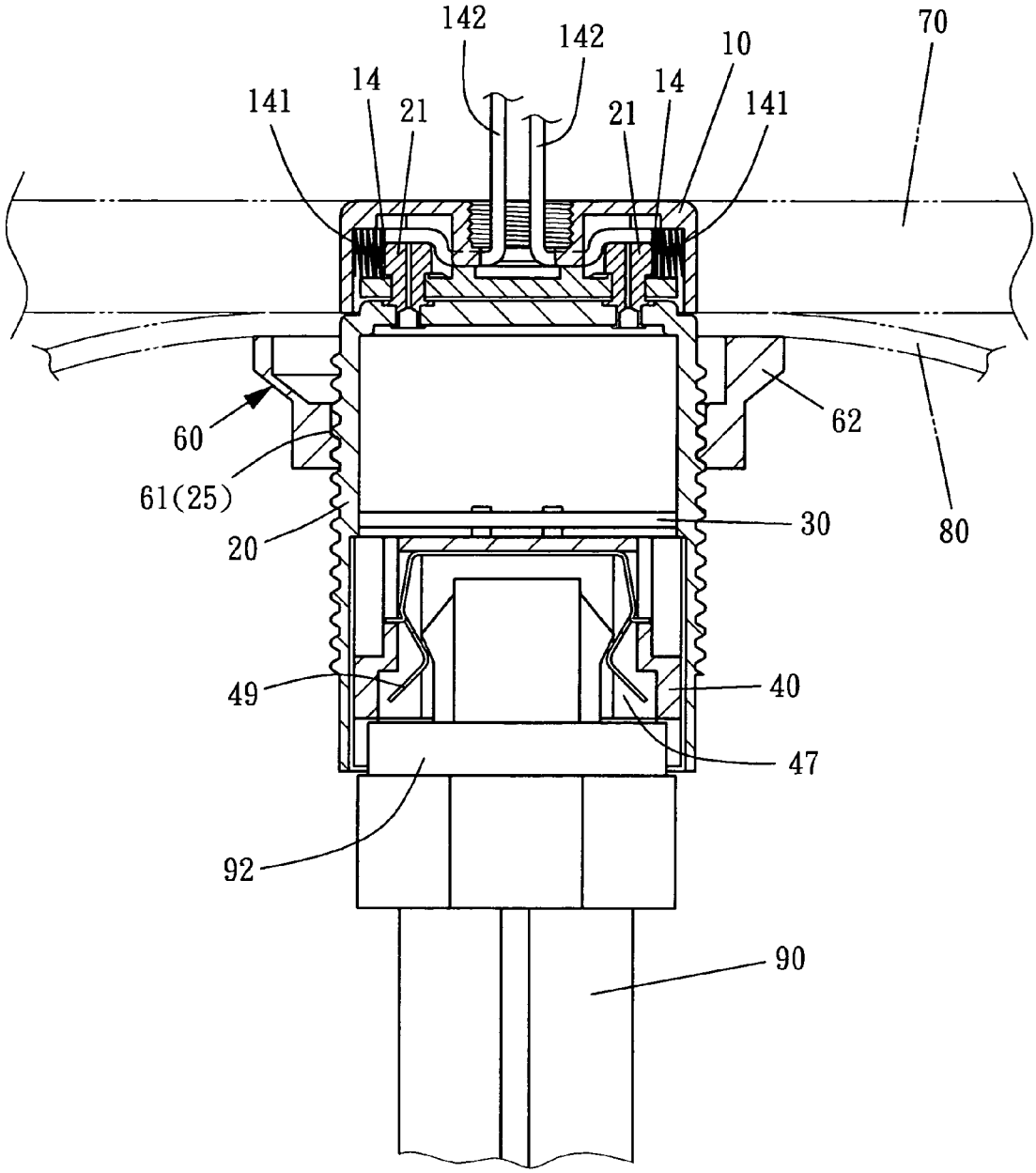
FIG. 13 is a schematic operational view of the lamp socket as shown in FIG. 12.
Figure 14:
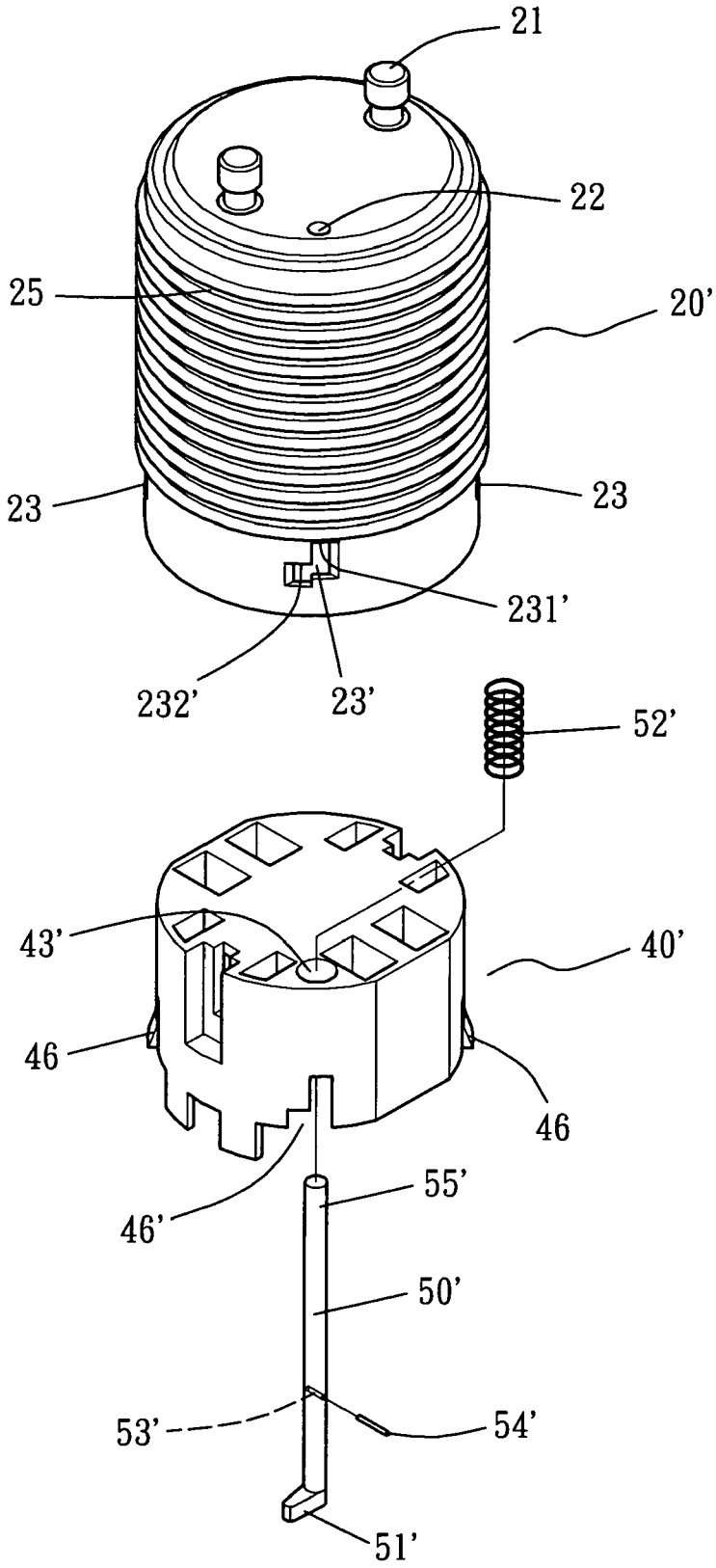
FIG. 14 is a partially exploded perspective view of a lamp socket in accordance with another preferred embodiment of the present invention.

In operation, referring to FIGS. 11-13 with reference to FIGS. 1-10, when the lamp socket is attached to a ceiling, the top cover 10 is mounted in the panel 70 of the ceiling as shown in FIG. 13, and the electric wires 142 of the top cover 10 are electrically connected to the power supply, so that the electric current from the power supply passes through the electrically conducting plates 14, the conducting rods 21 and the electric wires 31 into the circuit board 30 which transforms, filters and rectifies the electric current. At this time, A lamp shade 80 is mounted on the top cover 10. Then, the outer ring 60 is rotated to move upward on the housing 20, and the urging portion 62 of the outer ring 60 is moved upward to push the lamp shade 80 toward the panel 70 of the ceiling, so that the lamp shade 80 is clamped between the panel 70 of the ceiling and the outer ring 60.

Then, after the bottom portion 92 of the lamp tube 90 is inserted into the slot 47 of the base 40, the locking blocks (not shown) of the bottom portion 92 of the lamp tube 90 are clamped by the tube clip 49, and the electrically conducting posts (not shown) of the bottom portion 92 of the lamp tube 90 are inserted into the insertion holes 48 of the base 40 and clamped by the lower ends 422 of the respective conducting clip 42, so that the electric current from the circuit board 30 is introduced through the conducting clips 42 and the conducting posts into the lamp tube 90 so as to light the lamp tube 90.

At this time, the second end of the locking rod 50 is pushed upward by the bottom portion 92 of the lamp tube 90 to compress the restoring member 52, so that the first end 55 of the locking rod 50 is pushed upward and extended into one of the through holes 152 of the mounting plate 15 as shown in FIG. 11 to secure the housing 20 to the mounting plate 15 by the first end 55 of the locking rod 50 to prevent the housing 20 from being rotated relative to the mounting plate 15 and to prevent the housing 20 from being detached from the top cover 10.

Accordingly, after the bottom portion 92 of the lamp tube 90 is inserted into the slot 47 of the base 40, the second end of the locking rod 50 is pushed upward by the bottom portion 92 of the lamp tube 90, and the first end 55 of the locking rod 50 is pushed upward and extended into one of the through holes 152 of the mounting plate 15 to secure the housing 20 to the mounting plate 15 by the first end 55 of the locking rod 50, so that the housing 20 cannot be rotated relative to the mounting plate 15 to prevent the housing 20 from being rotated relative to the mounting plate 15 when the lamp socket is turned on, thereby protecting the user's safety when operating the lamp socket.

In addition, the first end 55 of the locking rod 50 is extended into one of the through holes 152 of the mounting plate 15 only when the through hole 22 of the housing 20 is aligned with one of the through holes 152 of the mounting plate 15, so that the housing 20 is connected with the mounting plate 15 exactly only when the first end 55 of the locking rod 50 is extended into one of the through holes 152 of the mounting plate 15, thereby ensuring exact connection between the housing 20 and the mounting plate 15.

Further, after the bottom portion 92 of the lamp tube 90 is removed from the slot 47 of the base 40, the locking rod 50 is pushed downward by the restoring force of the restoring member 52, and the first end 55 of the locking rod 50 is pushed downward to detach from one of the through holes 152 of the mounting plate 15 as shown in FIG. 4 to release the housing 20 from the mounting plate 15, so that the housing 20 can be rotated relative to the mounting plate 15 to detach the housing 20 from the mounting plate 15 for maintenance of the lamp socket.

Referring to FIGS. 14-18, the housing 20' has a lower portion having a peripheral wall formed with a stepped locking slot 23' having a lower resting portion 232' and an upper resting portion 231', the base 40' has a peripheral wall formed with a stepped locking slot 46' aligning with the locking slot 23' of the housing 20', the base 40' is formed with a through hole 43' to allow passage of the locking rod 50', the locking rod 50' has a second end provided with a transverse bar 51' that is movable between the lower resting portion 232' and the upper resting portion 231' of the locking slot 23' and a positioning shaft 54' located between the first end 55' of the locking rod 50' and the transverse bar 51', and the lamp socket further comprises a restoring member 52' mounted on the locking rod 50' and biased between a stepped face 45' formed in the through hole 43' of the base 40' and the positioning shaft 54' to push the positioning shaft 54' and the first end 55' of the locking rod 50' toward the respective through hole 152 of the mounting plate 15. The second end of the locking rod 50' is formed with a positioning hole 53' to position the positioning shaft 54'.

Figure 15:
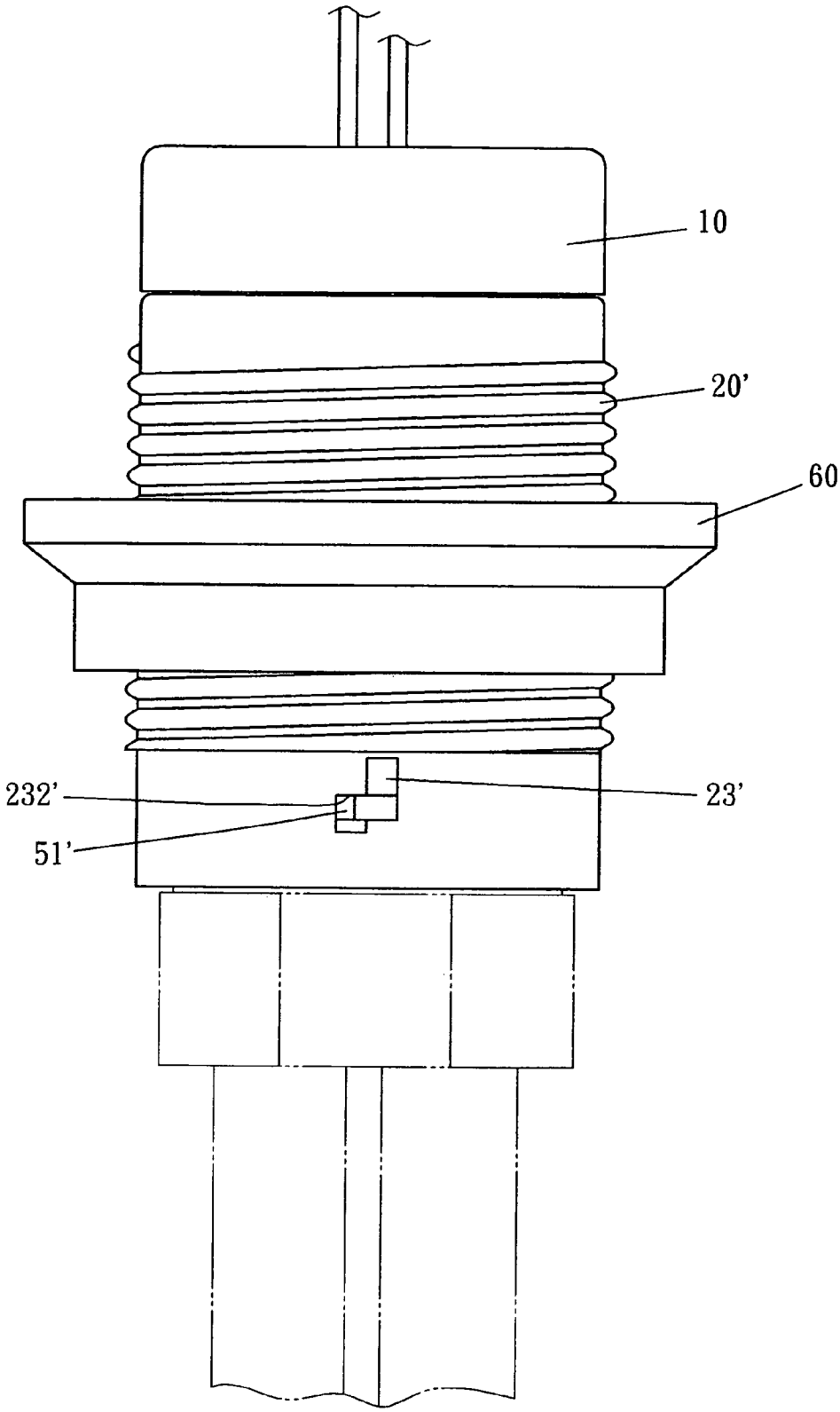
FIG. 15 is a plan assembly view of the lamp socket as shown in FIG. 14.
Figure 16:
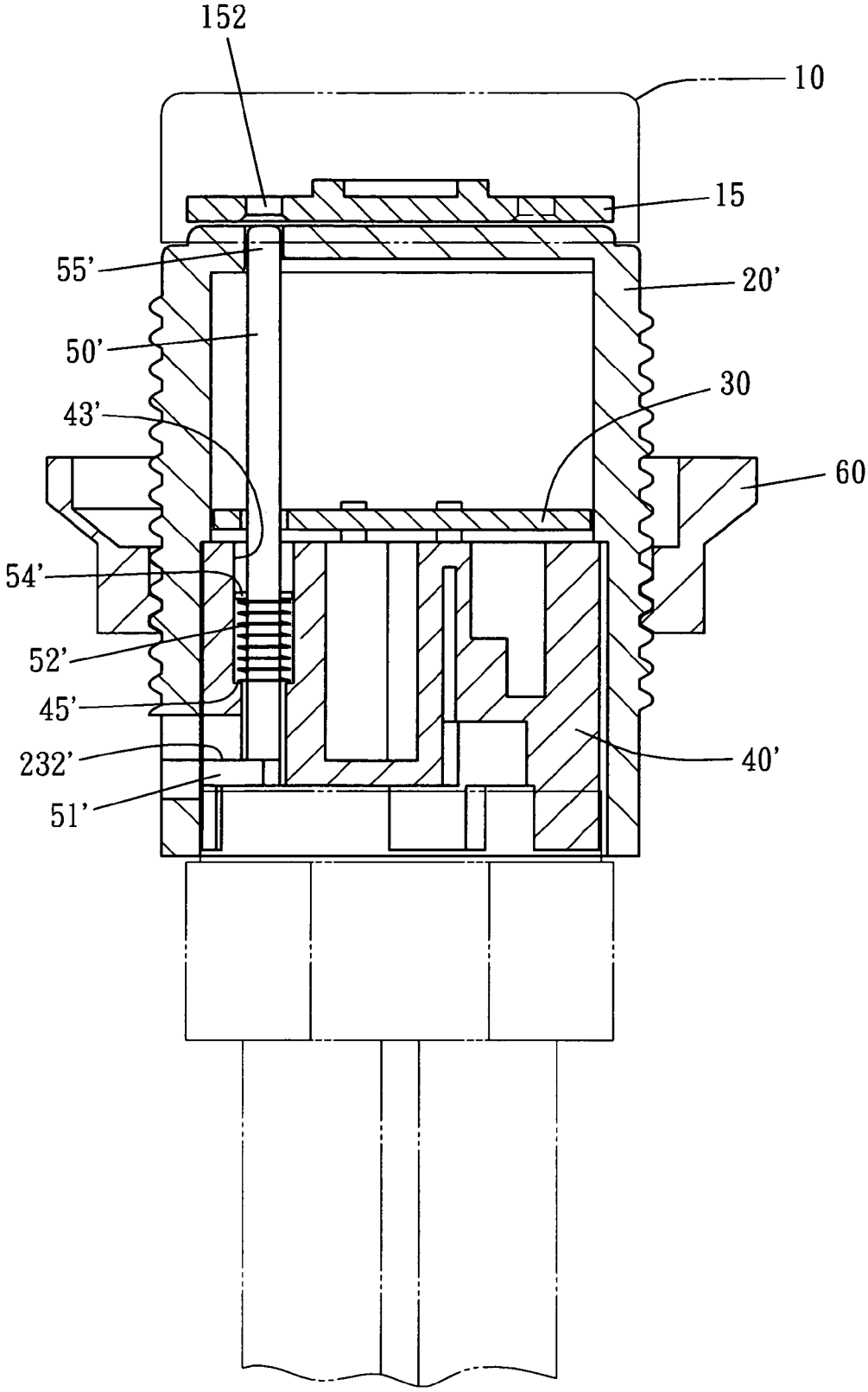
FIG. 16 is a plan cross-sectional view of the lamp socket as shown in FIG. 15.
Figure 17:
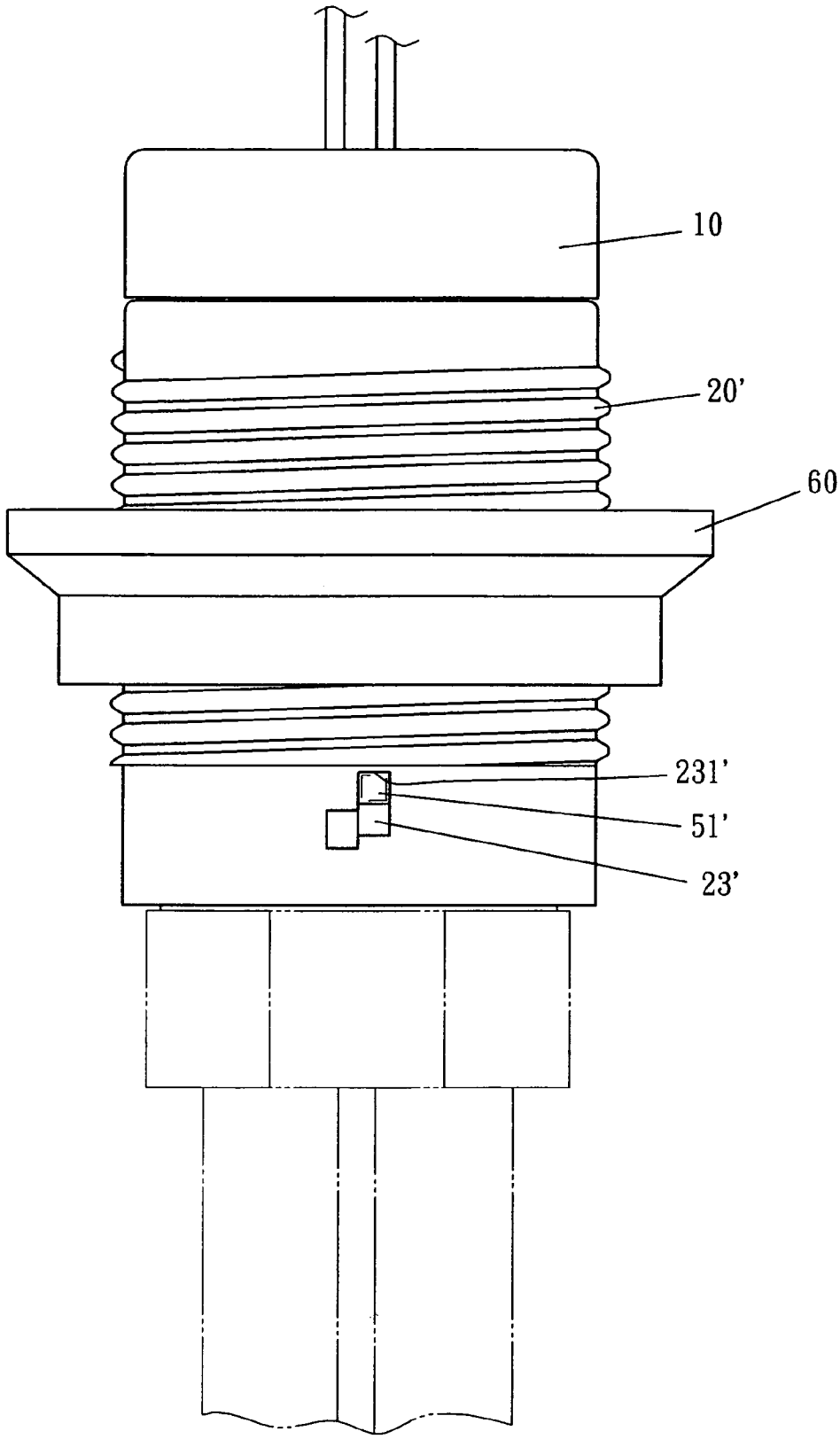
FIG. 17 is a schematic operational view of the lamp socket as shown in FIG. 15.
Figure 18:
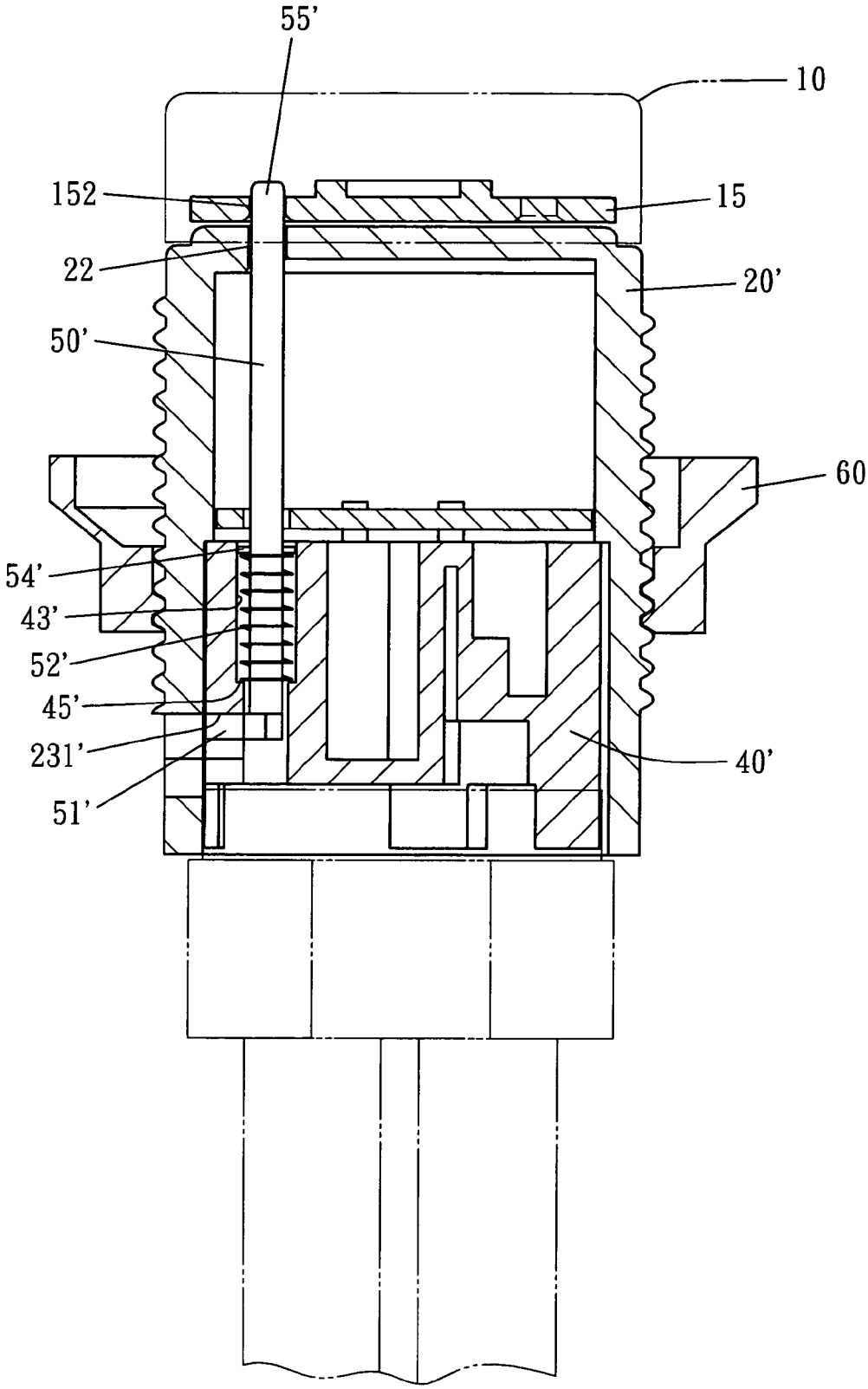
FIG. 18 is a schematic operational view of the lamp socket as shown in FIG. 16.

Thus, when the transverse bar 51' of the locking rod 50' is rested on the lower resting portion 232' of the locking slot 23' by rotation of the locking rod 50' as shown in FIG. 15, the restoring member 52' is compressed, and the first end 55' of the locking rod 50' is detached from the through holes 152 of the mounting plate 15 as shown in FIG. 16, and when the transverse bar 51' of the locking rod 50' is rested on the upper resting portion 231' of the locking slot 23' by rotation of the locking rod 50' as shown in FIG. 17, the first end 55' of the locking rod 50' is pushed upward by the restoring force of the restoring member 52' and extended into the through holes 152 of the mounting plate 15 as shown in FIG. 18.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp socket, comprising:

a top cover;

a mounting plate secured on the top cover;

a housing detachably mounted on the mounting plate;

a base secured in the housing;

a circuit board mounted in the housing and supported by the base; wherein:

the top cover has a hollow inside formed with two opposite slots;

the lamp socket further comprises two electrically conducting plates each inserted into the respective slot of the top cover;

the mounting plate has two radially opposite guide slots each having a first end aligning with the respective electrically conducting plate and a second end formed with a circular hole;

the housing has a top face provided with two radially opposite metallic conducting rods each detachably locked in the respective guide slot of the mounting plate and each urged on the respective electrically conducting plate;

the circuit board is provided with two electric wires each electrically connected to the respective conducting rod and has a periphery formed with a plurality of locking holes;

the base has a top face formed with a plurality of receiving chambers and a bottom face having a central portion formed with a slot and a periphery formed with a plurality of insertion holes each connected to the respective receiving chamber;

the lamp socket further comprises a tube clip mounted in the slot of the base, and a plurality of conducting clips each mounted in the respective receiving chamber of the base and each having an upper end provided with a conducting plate locked in and connected to the respective locking hole of the circuit board and a lower end facing the respective insertion hole of the base.

2. The lamp socket in accordance with claim 1, wherein each of the conducting rods of the housing is inserted through the circular hole into the respective guide slot of the mounting plate to reach the first end of the respective guide slot and has a reduced neck portion slidably mounted in the respective guide slot of the mounting plate.

3. The lamp socket in accordance with claim 1, wherein the housing has an inner wall formed with two radially opposite guide faces, and the base has an outer wall formed with two radially opposite guide faces each rested on the respective guide face of the housing.

4. The lamp socket in accordance with claim 1, wherein the housing has a lower portion having a peripheral wall formed with a plurality of locking holes, and the base has a peripheral wall formed with a plurality of flexible locking hooks each locked in the respective locking hole of the housing.

5. The lamp socket in accordance with claim 1, wherein the housing has an outer wall formed with an outer thread, and the lamp socket further comprises an outer ring rotatably and movably mounted on the housing and having an inner wall formed with an inner thread screwed onto the outer thread of the housing and an inner wall formed with an annular urging portion.

6. The lamp socket in accordance with claim 1, wherein the top cover has two radially opposite fixing holes, and the mounting plate has two radially opposite fixing holes each connected to the respective fixing hole of the top cover by a locking screw and a locking nut to attach the mounting plate to the top cover.

7. The lamp socket in accordance with claim 1, wherein the circular hole of each of the guide slots has a size greater than that of each of the guide slots.

8. The lamp socket in accordance with claim 1, wherein each of the slots of the top cover is defined by two substantially L-shaped limit plates, and each of the electrically conducting plates is limited by the limit plates of the respective slot.

9. The lamp socket in accordance with claim 1, wherein each of the electrically conducting plates has a thickness smaller than that of the respective slot of the top cover so that each of the electrically conducting plates is movable in the respective slot of the top cover.

10. The lamp socket in accordance with claim 1, wherein the housing has a hollow inside to receive the circuit board and the base.

11. The lamp socket in accordance with claim 1, wherein:

the top cover has a central portion formed with a screw bore;

the hollow inside of the top cover is formed with two receiving recesses each aligning with the respective slot;

the lamp socket further comprises two elastic members each mounted in the respective receiving recess of the top cover and each biased between the top cover and the respective electrically conducting plate to push the respective electrically conducting plate toward the central portion of the top cover, and two electric wires each having a first end attached to the respective electrically conducting plate and a second end extended through the screw bore of the top cover.

12. The lamp socket in accordance with claim 11, wherein when the housing is rotated relative to the mounting plate, the neck portion of each of the conducting rods is slidable in the respective guide slot of the mounting plate to reach the first end of the respective guide slot, so that each of the conducting rods is urged on the respective electrically conducting plate to compress the respective elastic member.

13. A lamp socket, comprising:

a top cover;

a mounting plate secured on the top cover;

a housing detachably mounted on the mounting plate;

a base secured in the housing;

a circuit board mounted in the housing and supported by the base;

a locking rod movably mounted in the base and having a first end extended through the circuit board and the housing and retractably extended into the mounting plate to lock the housing onto the mounting plate.

14. The lamp socket in accordance with claim 13, wherein the base is formed with a through hole to allow passage of the locking rod, the circuit board is formed with a through hole to allow passage of the locking rod, the top face of the housing is formed with a through hole to allow passage of the locking rod, the mounting plate has two radially opposite through holes, and the first end of the locking rod is retractably extended into one of the through holes of the mounting plate.

15. The lamp socket in accordance with claim 14, wherein the locking rod has a second end provided with a transverse bar that is rotatable to rest on a stepped face formed in the housing, and the lamp socket further comprises a restoring member mounted on the locking rod and biased between a stepped face formed in the through hole of the base and the transverse bar of the locking rod to push the transverse bar of the locking rod toward the stepped face of the housing.

16. The lamp socket in accordance with claim 15, wherein when the transverse bar of the locking rod is rested on the stepped face of the housing, the first end of the locking rod is flush with the through hole of the housing, and the second end of the locking rod is exposed from the through hole of the base.

17. The lamp socket in accordance with claim 13, wherein the base is formed with a through hole to allow passage of the locking rod, the top face of the housing is formed with a through hole to allow passage of the locking rod, the mounting plate has two radially opposite through holes, the first end of the locking rod is retractably extended into one of the through holes of the mounting plate, the housing has a lower portion having a peripheral wall formed with a stepped locking slot having a lower resting portion and an upper resting portion, the base has a peripheral wall formed with a stepped locking slot aligning with the locking slot of the housing, the locking rod has a second end provided with a transverse bar that is movable between the lower resting portion and the upper resting portion of the locking slot and a positioning shaft located between the first end of the locking rod and the transverse bar, and the lamp socket further comprises a restoring member mounted on the locking rod and biased between a stepped face formed in the through hole of the base and the positioning shaft to push the positioning shaft and the first end of the locking rod toward the respective through hole of the mounting plate.

18. The lamp socket in accordance with claim 17, wherein the second end of the locking rod is formed with a positioning hole to position the positioning shaft.

19. The lamp socket in accordance with claim 17, wherein when the transverse bar of the locking rod is rested on the lower resting portion of the locking slot by rotation of the locking rod, the restoring member is compressed, and the first end of the locking rod is detached from the through holes of the mounting plate, and when the transverse bar of the locking rod is rested on the upper resting portion of the locking slot by rotation of the locking rod, the first end of the locking rod is pushed upward by the restoring force of the restoring member and extended into the through holes of the mounting plate.

* * * * *